US007662484B2

(12) United States Patent
Kliewe

(10) Patent No.: US 7,662,484 B2
(45) Date of Patent: Feb. 16, 2010

(54) COMPONENT, ANTI-OXIDATION COATING FOR SUCH A COMPONENT AND METHOD OF PRODUCING THE SAME

(75) Inventor: Anja Kliewe, Munich (DE)

(73) Assignee: MTU Aero Engines GmbH, Munich (DE)

( * ) Notice: Subject to any disclaimer, the term of this patent is extended or adjusted under 35 U.S.C. 154(b) by 248 days.

(21) Appl. No.: 10/577,634

(22) PCT Filed: Oct. 4, 2004

(86) PCT No.: PCT/DE2004/002194

§ 371 (c)(1),
(2), (4) Date: Apr. 28, 2006

(87) PCT Pub. No.: WO2005/045089

PCT Pub. Date: May 19, 2005

(65) Prior Publication Data

US 2007/0134095 A1 Jun. 14, 2007

(30) Foreign Application Priority Data

Oct. 31, 2003 (DE) ..... 103 50 882

(51) Int. Cl.

| | |
|---|---|
| ***B32B 15/00*** | (2006.01) |
| ***B32B 15/01*** | (2006.01) |
| ***C25D 7/00*** | (2006.01) |
| ***B05D 3/02*** | (2006.01) |

(52) U.S. Cl. ..... 428/615; 428/680; 428/670; 416/241 R; 427/383.7

(58) Field of Classification Search ..... 428/615, 428/680, 670; 416/241 R, 229 R; 427/372.2, 427/383.1, 383.3, 383.7

See application file for complete search history.

(56) References Cited

U.S. PATENT DOCUMENTS 5,482,578 A * 1/1996 Rose et al. ..... 148/516
6,066,405 A * 5/2000 Schaeffer ..... 428/547

FOREIGN PATENT DOCUMENTS

| | | |
|---|---|---|
| EP | 0 718 420 | 6/1996 |
| EP | 0 784 104 | 7/1997 |
| EP | 1 076 116 | 2/2001 |
| EP | 1 094 131 | 4/2001 |

* cited by examiner

*Primary Examiner*—Timothy M Speer
*Assistant Examiner*—Gordon R Baldwin
(74) *Attorney, Agent, or Firm*—W. F. Fasse; W. G. Fasse

(57) ABSTRACT

A component such as a gas turbine engine component has an oxidation protective layer formed as a substrate surface region in a substrate of the component. The substrate has a nickel-based composition including nickel and an aluminum proportion of greater than 4.5 weight %. The surface region is formed by diffusion of at least platinum into the substrate surface region to provide an integrated platinum proportion of 5 to 40 weight percent over the integration depth range in the surface region.

20 Claims, 1 Drawing Sheet

COMPONENT, ANTI-OXIDATION COATING FOR SUCH A COMPONENT AND METHOD OF PRODUCING THE SAME

FIELD OF THE INVENTION

The invention relates to a component, especially a component of a gas turbine. Moreover, the invention relates to an oxidation protective or anti-oxidation coating for such a component, and a method for the production thereof.

BACKGROUND INFORMATION

The EP 0 784 104 B1 relates to a super-alloy on a nickel basis with optimized platinum-aluminum coating. Thus, this state of the art discloses an object with a platinum-aluminum surface region, whereby a substrate comprises a substrate composition on a nickel basis and a substrate surface, whereby first platinum and thereafter aluminum is diffused into the substrate surface, and whereby through these means a substrate region is prepared, which comprises an integrated aluminum content of 18 to 24 weight %, an integrated platinum content of 18 to 45 weight %, as well as a remainder with components of the substrate mass composition. The substrate region formed in this manner forms a protective layer for the substrate. According to the EP 0 784 104 B1, the integrated values of aluminum and platinum are determined by an integration method whereby the platinum content as well as the aluminum content is integrated over the spacing distance from the outer substrate surface. A lower integration limit lies at approximately 2 to 3 μm below the substrate surface. An upper integration limit is determined by the spacing distance from the substrate surface, at which the aluminum content measured in weight percent is reduced to a value of 18 weight % beginning from larger values. This upper integration limit is used both for the determination of the integrated aluminum proportion as well as for the determination of the integrated platinum proportion. In the sense of this state of the art, the preparation of the platinum-aluminum surface region is achieved through two successively performed diffusion processes. Through the separate aluminizing or alitizing, the production of such a surface region acting as a protective layer is time consuming and expensive.

SUMMARY OF THE INVENTION

Beginning from this, it is the underlying problem of the present invention to propose a novel component with a substrate region, a novel oxidation protective or anti-oxidation coating and a method for the production of such a component. This problem is solved in that the above mentioned component is further developed through the features of the present invention.

According to the invention, the component comprises a substrate composition on a nickel basis with an aluminum proportion of greater than 4.5 weight %. Exclusively at least one metal of the platinum group is diffused into the substrate surface of the component for the formation of the substrate surface region.

It is the underlying recognition of the present invention that a substrate surface region serving as an oxidation protection layer or region of a component of which the substrate composition on a nickel basis or nickel alloy basis comprises an aluminum proportion of at least 4.5 weight %, can be produced in that exclusively at least one metal of the platinum group, preferably exclusively platinum, is diffused into the substrate surface of the component. Such a substrate region on the surface of the component has a good oxidation resistance or durability, and the same can be produced more economically than substrate regions known from the state of the art, in which a separate aluminizing or alitizing process is necessary after the in-diffusion of the platinum.

According to an advantageous further development or embodiment of the invention, exclusively platinum is diffused into the substrate surface of the component for the formation of the substrate region, whereby the integrated proportion of platinum (Pt) in the substrate region amounts to between 5 and 40 weight %, preferably between 5 and 30 weight %, and whereby the proportion of aluminum (Al) in the substrate region is determined by the substrate composition of the component.

Preferred further developments or embodiments of the invention arise from the dependent claims and the following description.

BRIEF DESCRIPTION OF THE DRAWING

Example embodiments of the invention are described in further detail in connection with the drawing, without being limited hereto. In the drawing.

DETAILED DESCRIPTION OF EXAMPLE EMBODIMENTS OF THE INVENTION

Figure 1:
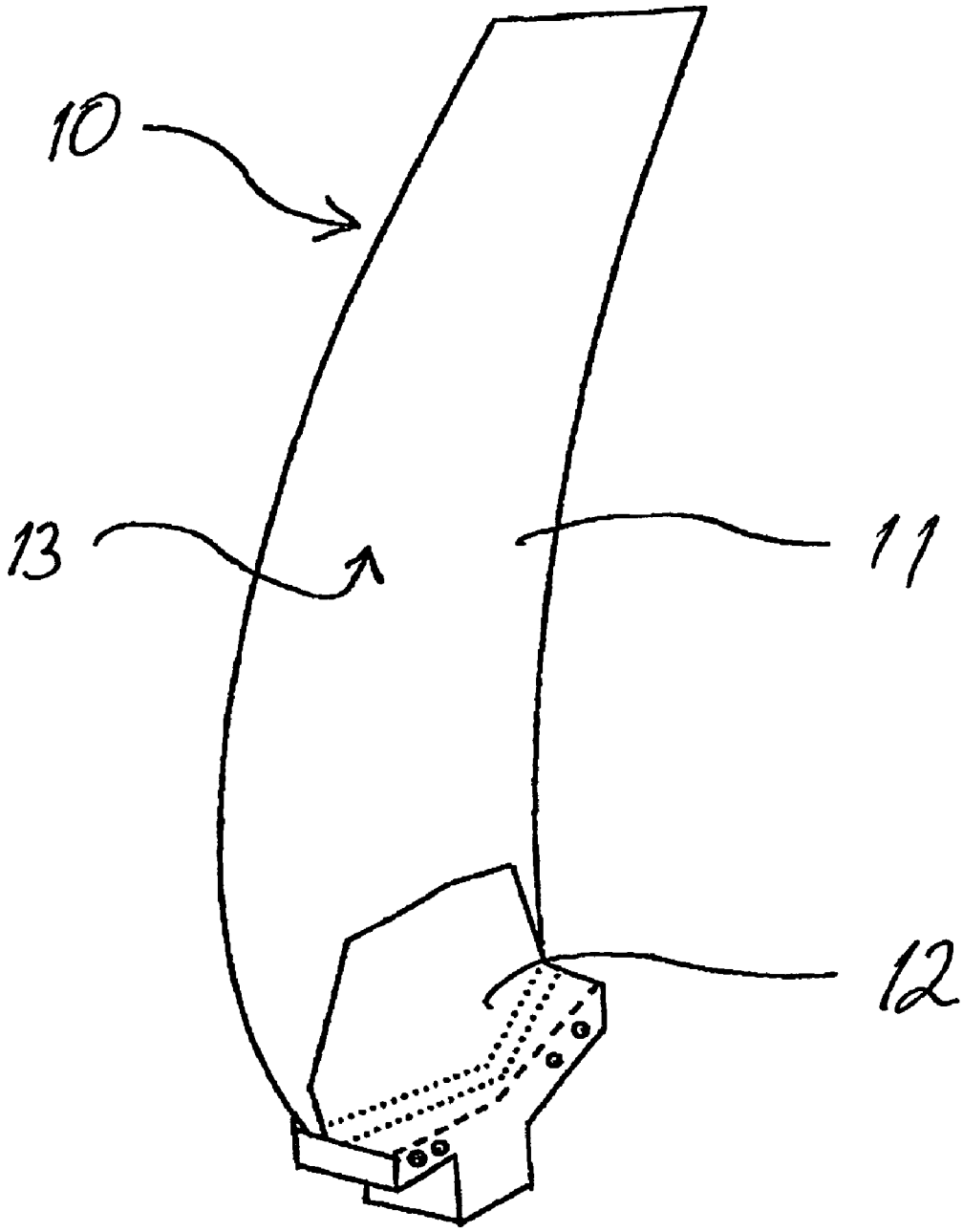
FIG. 1 shows a component embodied according to the invention.

In the following, the present invention is described in greater detail with reference to FIG. 1. FIG. 1 shows a blade 10 of a gas turbine, namely an aircraft engine. The blade 10 has a blade proper or blade vane 11 as well as a blade root, base or pedestal 12. In the illustrated example embodiment, the entire blade 10, namely both the blade vane 11 as well as the blade base or pedestal 12, is coated in the region of a surface 13 of the blade 10 for the preparation of an oxidation protection.

The blade 10 forms a substrate for the coating for the formation of the oxidation protection on the surface 13 of the blade 10. The surface 13 of the substrate embodied as a blade 10 is thus also referred to as the substrate surface. The blade 10 has a mass composition or substrate composition on a nickel basis.

It is now in the sense of the present invention, to apply an oxidation protective coating onto a substrate with a substrate composition on a nickel basis with an aluminum proportion of greater than 4.5 weight %, in that exclusively at least one metal of the platinum group, preferably platinum and/or palladium, is diffused into the substrate surface. In the preferred example embodiment, exclusively platinum is diffused into the substrate surface of the blade 10.

As already mentioned, the blade 10 has a substrate composition on a nickel basis with an aluminum proportion of greater than 4.5 weight %. The substrate composition on a nickel basis comprises an aluminum proportion of maximally 10 weight %.

In the preferred example embodiment, the platinum is diffused into the substrate surface 13 of the blade 10 in such a manner so that the integrated proportion of platinum in the platinum-aluminum substrate region being formed amounts to between 5 and 40 weight %, preferably between 5 and 30 weight %, and especially preferably between 5 and 17.99 weight %. The proportional content of aluminum and the remaining components is determined by the mass composition of the blade 10 or the substrate composition.

In the sense of the present invention it is thus proposed, to produce an oxidation protective coating for a component of a gas turbine with a substrate composition on a nickel basis, in that exclusively platinum and/or palladium, preferably exclusively platinum, is diffused into the substrate surface of the component. The aluminizing or alitizing process that is necessary according to the state of the art, can be completely omitted or avoided. A good oxidation resistance or durability can be produced.

The above mentioned platinum proportions in the substrate region are integrated proportions. The integrated proportions are determined through an integration method. In this integration method, an integration is carried out over the spacing distance d from the outer substrate surface, whereby the platinum proportion is dependent on the spacing distance or respectively on the depth relative to the outer substrate surface. In the sense of the present invention, the lower integration boundary or limit is formed either by the substrate surface itself or by a point directly below the substrate surface. In the case in which the lower integration boundary or limit is formed by the substrate surface itself, $x_{min}$=0 μm; in the case in which the lower integration boundary or limit is formed by a point directly below the substrate surface, $x_{min}$ amounts to preferably 5 μm. An upper integration boundary or limit $x_{max}$ is formed by the spacing distance or respectively by the depth relative to the substrate surface, at which the proportion of platinum has diminished to 5 weight % and remains under this value. The value of the integral is then still further divided by the difference between the upper integration limit $x_{max}$ and the lower integration limit $x_{min}$ so that then $I_{Pt\text{-}int}$ pertains for the determination of the integrated platinum proportion:

$$I_{Pt-int} = \frac{1}{x_{max} - x_{min}} * \int_{x_{min}}^{x_{max}} I_{Pt}(x)dx$$

wherein:

$I_{Pt\text{-}int}$=integrated proportion of platinum $I_{pt}(x)$=proportion of platinum as a function of x x=spacing distance or depth from the outer substrate surface $x_{min}$=lower integration limit $x_{max}$=upper integration limit For the production of a component with such an oxidation protective or anti-oxidation layer, one proceeds such that in a first step a corresponding component with a substrate surface and a substrate composition is prepared or provided, whereby the substrate composition on a nickel basis comprises an aluminum proportion of at least 4.5 weight %. Then, exclusively at least one metal of the platinum group is diffused into a substrate surface of this component. In the sense of the invention, preferably platinum and/or palladium is diffused into the substrate surface, whereby the in-diffusion of exclusively platinum into the substrate surface is preferred. The in-diffusion of platinum is carried out in a drossing or slurry coating technique. In that regard, a corresponding platinum drossing or slurry material is applied onto the surface of the substrate and thereafter is aged or hardened.

The invention claimed is:

1. A metallic article comprising a metallic substrate including a protective layer adapted to provide protection against at least one of oxidation or corrosion at a substrate surface of said substrate, wherein:

said substrate has a nickel-based substrate composition comprising nickel or a nickel alloy and further comprising a content of aluminum representing greater than 4.5 weight percent of said substrate composition;

said protective layer is a surface region in said substrate, extending into said substrate from said substrate surface, as formed by diffusion of at least platinum into said substrate surface; and said surface region has a content of said platinum such that an integrated proportion of said platinum over an integration depth range is from 5 to 30 weight percent of an overall composition of said integration depth range, which extends from a minimum integration depth to a maximum integration depth, wherein said minimum integration depth is from 0 to 5 μm into said substrate from said substrate surface, and wherein said maximum integration depth is a depth, into said substrate from said substrate surface, at which a local content percentage of said platinum has diminished to 5 weight percent.

2. The metallic article according to claim 1, wherein said minimum integration depth is 0 μm.

3. The metallic article according to claim 1, wherein said integrated proportion of said platinum over said integration depth range is from 5 to 17.99 weight percent of said overall composition of said integration depth range.

4. The metallic article according to claim 3, wherein said minimum integration depth is 0 μm.

5. The metallic article according to claim 1, wherein said content of aluminum represents at most 10 weight percent of said substrate composition.

6. The metallic article according to claim 1, wherein a proportion of said aluminum relative to said nickel or said nickel alloy in said surface region corresponds to a proportion of said aluminum relative to said nickel or said nickel alloy in said substrate composition.

7. The metallic article according to claim 1, wherein said metallic article is a component of a gas turbine.

8. The metallic article according to claim 1, wherein said metallic article is a component of a gas turbine aircraft engine.

9. The metallic article according to claim 1, wherein said metallic article is a gas turbine blade.

10. The metallic article according to claim 1, wherein said protective layer is formed by diffusion of exclusively at least one platinum-group element including said platinum into said substrate surface.

11. The metallic article according to claim 1, wherein said protective layer is formed by diffusion of exclusively said platinum into said substrate surface.

12. The metallic article according to claim 1, wherein said protective layer consists of said nickel-based substrate composition and said platinum.

13. The metallic article according to claim 1, wherein said metallic article does not include an aluminized or alitized surface layer.

14. A metallic article including a corrosion or oxidation protective layer at a surface of a metallic substrate, wherein:

said substrate has a nickel-based substrate composition comprising nickel or a nickel alloy and further comprising a content of aluminum more than 4.5 weight percent of said substrate composition;

said protective layer is a surface region in said substrate consisting of platinum diffused into said substrate composition in said surface region from a substrate surface of said substrate;

said surface region extends from said substrate surface into said substrate to a depth at which a local concentration of said platinum has diminished to 5 weight percent;

said surface region has an averaged content of said platinum from 5 to 17.99 weight percent of an overall composition of said surface region; and said overall composition of said surface region consists of said substrate composition and said platinum.

15. A method of producing a metallic article having an oxidation or corrosion protective layer at a substrate surface of a metallic substrate, comprising the steps:

a) providing said metallic substrate that has a nickel-based substrate composition comprising nickel or a nickel alloy and further comprising a content of aluminum greater than 4.5 weight percent of said substrate composition; and b) diffusing platinum into said substrate surface of said substrate so as to form said protective layer as a surface region in said substrate extending from said substrate surface to a depth in said substrate at which a local content percentage of said platinum has diminished to 5 weight percent;

wherein said surface region has an integrated proportional content of said platinum being from 5 to 40 weight percent of an overall composition of said surface region; and wherein said diffusing step comprises applying a platinum slurry material onto said substrate surface and then age hardening said metallic substrate with said platinum slurry material on said substrate surface, so that said platinum diffuses from said platinum slurry material through said substrate surface into said surface region of said substrate.

16. The method according to claim 15, wherein said integrated proportional content of said platinum is from 5 to 30 weight percent of said overall composition of said surface region.

17. The method according to claim 15, wherein said integrated proportional content of said platinum is from 5 to 17.99 weight percent of said overall composition of said surface region.

18. The method according to claim 15, wherein said diffusing step consists of diffusing exclusively platinum into said substrate surface so as to form said protective layer as said surface region.

19. The method according to claim 15, excluding any aluminizing or alitizing step.

20. A metallic article comprising a metallic substrate including a protective layer adapted to provide protection against at least one of oxidation or corrosion at a substrate surface of said substrate, wherein:

said substrate has a nickel-based substrate composition comprising nickel or a nickel alloy and further comprising a content of aluminum representing greater than 4.5 weight percent of said substrate composition;

said protective layer is a surface region in said substrate, extending into said substrate from said substrate surface, as formed by diffusion of at least platinum into said substrate surface; and said surface region has a content of said platinum such that an integrated proportion of said platinum over an integration depth range is from 5 to 40 weight percent of an overall composition of said integration depth range, which extends from a minimum integration depth to a maximum integration depth, wherein said minimum integration depth is at said substrate surface, and wherein said maximum integration depth is a depth, into said substrate from said substrate surface, at which a local content percentage of said platinum has diminished to 5 weight percent.

* * * * *

UNITED STATES PATENT AND TRADEMARK OFFICE

CERTIFICATE OF CORRECTION

PATENT NO. : 7,662,484 B2
APPLICATION NO. : 10/577634
DATED : February 16, 2010
INVENTOR(S) : Anja Kliewe It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 542 days.

Signed and Sealed this

Thirtieth Day of November, 2010

David J. Kappos

David J. Kappos
*Director of the United States Patent and Trademark Office*